United States Patent [19]

Bingler

[11] 4,152,099

[45] May 1, 1979

[54] MAGNETICALLY COUPLED PUMP AND IMPELLER ASSEMBLY THEREFOR

[75] Inventor: Douglas J. Bingler, Furlong, Pa.

[73] Assignee: Milton Roy Company, St. Petersburg, Fla.

[21] Appl. No.: 801,801

[22] Filed: May 31, 1977

[51] Int. Cl.[2] ..... F04B 17/00

[52] U.S. Cl. ..... 417/420; 64/28 M; 192/84 PM; 308/237 R; 310/104; 403/368

[58] Field of Search ..... 415/170 R, 214; 417/420; 403/368, 371, 370; 308/237 R, 238, DIG. 7; 64/28 M; 192/6 M; 416/204

[56] References Cited

U.S. PATENT DOCUMENTS

| | | | |
|---|---|---|---|
| 2,347,386 | 4/1944 | Adams | 415/214 |
| 2,879,112 | 3/1959 | Cox | 308/237 R |
| 3,021,049 | 2/1962 | Settle | 416/204 |
| 3,082,338 | 3/1963 | Turk | 310/90 |
| 3,205,827 | 9/1965 | Zimmermann | 417/420 |
| 3,238,878 | 3/1966 | Martin | 417/420 |
| 3,411,450 | 11/1968 | Clifton | 310/104 |
| 3,420,184 | 1/1969 | Engelesberg et al. | 310/104 |
| 3,513,339 | 5/1970 | Harris et al. | 310/90 |
| 3,531,216 | 9/1970 | Callahan | 403/371 |

*Primary Examiner*—C. J. Husar

*Attorney, Agent, or Firm*—Woodcock, Washburn, Kurtz & Mackiewicz

[57] ABSTRACT

Described is a magnetically coupled pump and an impeller assembly therefor. In a magnetically coupled pump wherein the hub portion of a rotary impeller is inserted within the bore of a hollow cylindrical driven magnet to be rotated by a surrounding annular driving magnet, the hub portion of the impeller is provided with a deformable projection. A tapered wedge is inserted into the bore to deform the projection and to attach the driven magnet to the hub. The tapered wedge is formed of graphite which also performs the function of a bushing upon which the impeller is rotated.

12 Claims, 5 Drawing Figures

MAGNETICALLY COUPLED PUMP AND IMPELLER ASSEMBLY THEREFOR

BACKGROUND OF THE INVENTION

1. Field of the Invention

The present invention relates in general to magnetically coupled pumps of the type having a rotary impeller which is rigidly attached to a cylindrical permanent magnet that is driven by a torque from a surrounding annular permanent magnet, the two magnets being separated from one another by a wall of the pump housing. In particular, the present invention relates to a rotary impeller which is more easily attached to the driven magnet than impellers known in the prior art.

2. Description of the Prior Art

Magnetically coupled pumps are well known in the prior art as evidenced by U.S. Pat. Nos. 3,205,827; 3,465,681; 3,545,892; 3,802,804; 3,932,068 and 3,938,914. These pumps are of a type having a rotary impeller having an integral hub portion upon which is mounted a hollow cylindrical driven magnet. The driven magnet is mounted by the insertion of the hub portion of the impeller into the bore of the magnet. The driven magnet, in turn, is rotated by a torque supplied by an annular driving magnet which is separated from the driven magnet by a wall of the pump housing. The rotation of the driven magnet thus drives the impeller.

One long-felt problem associated with such prior art pumps has been to provide a satisfactory means for fastening the impeller hub to the driven magnet. If the driven magnet is not adequately fastened to the hub, slippage will result in that the driven magnet will rotate while the hub and the impeller blades remain stationary. In order to alleviate this problem, it has been common to form the bore of the hollow cylindrical driven magnet such that it is only slightly larger than the impeller hub. In this manner, friction between the driven magnet and the hub will eliminate any slippage. However, sintered ceramic magnets have been preferred for use as the driven magnet because of their ability to retain flux and these sintered magnets are easily cracked and chipped when being force fit onto the impeller hub. Further, the precision grinding of the bore of these magnets is an expensive manufacturing operation which increases the cost of the pump.

Another problem associated with prior art magnetically coupled pumps, especially those with molded plastic impellers, is wear caused by the rotation of moving parts such as the impeller over stationary surfaces.

OBJECTS OF THE INVENTION

It is an object of the present invention to provide a magnetically coupled pump and an impeller assembly therefor which eliminates the need for precision machining of the driven magnet.

It is a further object of the present invention to provide a pump which is protected from wear.

The present invention achieves these objectives by providing a drive magnet having a bore which is substantially larger than that portion of the hub of the rotary impeller upon which it is mounted. The hub is provided with a deformable projection which is inserted into the bore of the driven magnet, and a wedge is then inserted into the bore. The projection is deformed radially by the wedge so that the impeller and the driven magnet tightly abut one another.

The present invention will be better understood by reference to the accompanying drawings in which.

DESCRIPTION OF THE PREFERRED EMBODIMENTS

Figure 1:
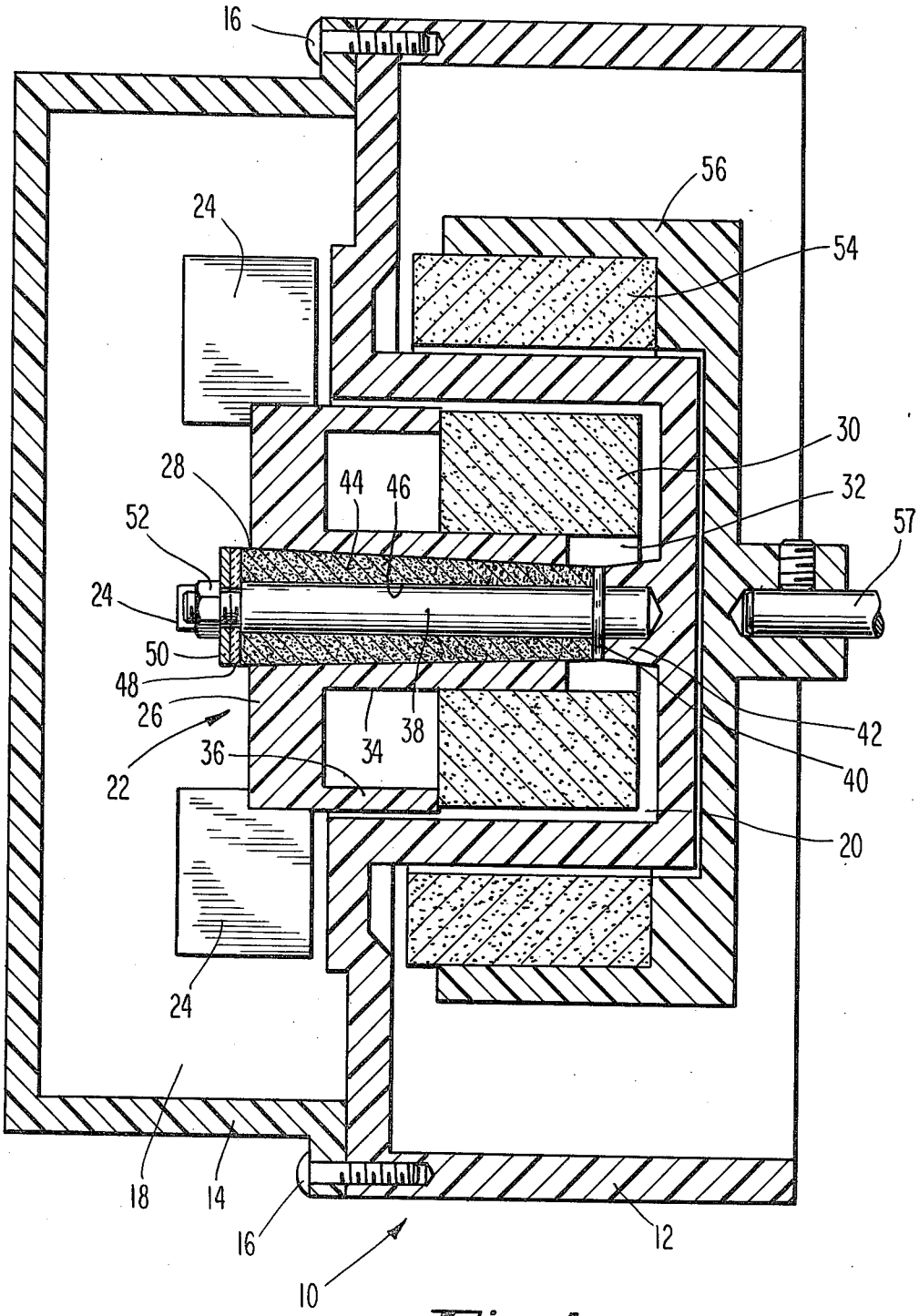
FIG. 1 is a cross-sectional view of a magnetically coupled pump manufactured in accordance with the teachings of the present invention.

Referring now to FIG. 1, a magnetically coupled pump assembly is shown generally at 10. The pump assembly 10 is encased within a first housing member 12 and a second housing member 14, which are joined together by a suitable fastening means such as bolts 16.

The joined housing members 12 and 14 define between them an impeller chamber 18 and a magnet well 20, adapted to receive a hollow cylindrical permanent driven magnet 30.

Communicating with the impeller chamber 18 are inlet and outlet ports, not shown, through which liquid enters and exits the impeller chamber 18. Situated within the impeller chamber 18 is a rotary impeller shown generally as 22. The impeller 22 comprises a blade portion shown by blades 24 and a hub portion 26. Located at the center of the hub portion 26 a central opening 28 may be found.

Preferably the housing members 12 and 14 and the impeller 24 are formed of a material which is resistant to chemical attack such as a molded plastic. One particular plastic which has been found to be effective in this regard is polyphenylene sulfide.

Situated within the magnet well 20 is a hollow cylindrical driven magnet 30. The driven magnet 30 is a permanent magnet of the type which is usually formed of pressure-molded magnetic compositions of the class of barium ferrite which are sometimes characterized as "sintered ceramic" magnets. Sintered ceramic magnets should be distinguished from magnets formed of essentially metallic ferrous magnetic materials, such as alloys containing nickle and like materials in combination with iron. As mentioned above, sintered ceramic magnets are chosen because of their excellent ability to retain flux. The driven magnet 30 is formed to have a bore 32 running the length of its central axis. The bore 32 is preferably formed by grinding. However, the diameter of the bore is not critical as will be described below.

Also situated within the magnet well 20 is a deformable projection 34 and a circumferential projection 36 which extend axially from and which are integral with the hub portion 26 of the rotary impeller 22. The particular structure and advantages of the deformable projection 34 will also be more fully explained below.

Communicating between the impeller chamber 18 and the magnet well 20 is an impeller shaft 38 which passes through the bore 32 of the driven magnet 30 and the central opening 28 of the hub portion 26. The impeller shaft 38 is preferably formed of a non-magnetic material which resists corrosion such as stainless steel. In one embodiment, the shaft may be formed to have a circumferential flange 40 near the end of the shaft which is situated within the magnet well 20. Further, in the preferred embodiment the flange is supported within an anchor 42 which has been formed to extend from the first housing member 12 and which is integral therewith.

Figure 2:
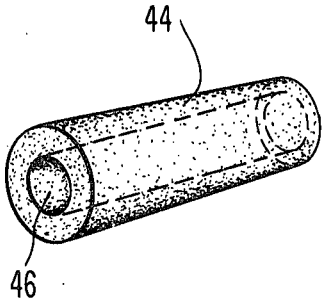
FIG. 2 is a perspective view of a tapered wedge used to join the impeller hub and the driven magnet according to the present invention.

Encircling the shaft 38 is a tapered wedge 44 having a longitudinal opening 46 therein as shown in FIG. 2. The wedge 44 is preferably formed of graphite or other bushing material such as brass. A small portion of the wedge projects through the central opening 28 and into the impeller chamber 18 as shown.

That portion of the shaft 38 which extends into the impeller chamber 18 is threaded and this threaded portion receives a bushing in the form of a ceramic washer 48 which abuts the graphite wedge 44. The threaded portion also receives a metal washer 50. The ceramic washer 48 and the metal washer 50 are retained by a lock nut 52.

Situated outside of the impeller chamber 18 and the magnet well 20, but still within the first housing member 12, an annular drive magnet 54 which surrounds the driven magnet 30 may be seen. The drive magnet 54 is also preferably a sintered ceramic magnet and the drive magnet 54 is supported on a drive magnet carrier 56. The drive magnet carrier 56 is adapted to rotate about the magnet well 20 due to the rotation of a power shaft 50 which is connected to a suitable motor, not shown.

Figure 3:
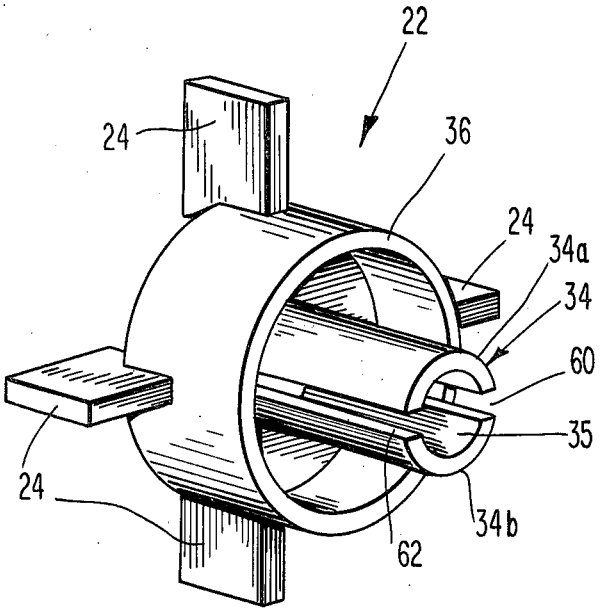
FIG. 3 is a perspective view of the rotary impeller of the pump shown in FIG. 1.
Figure 4:
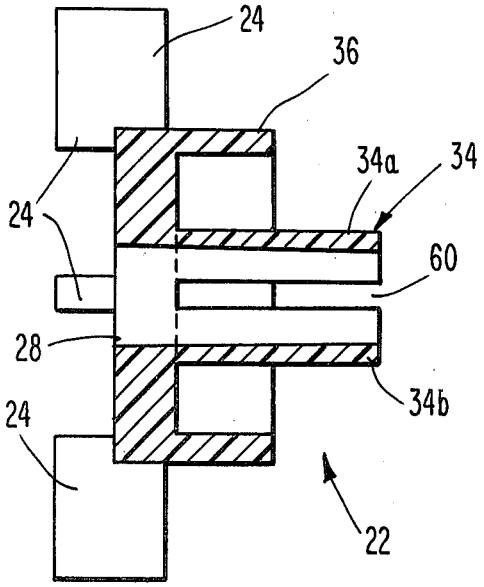
FIG. 4 is a longitudinal cross-sectional view of the impeller shown in FIG. 3.
Figure 5:
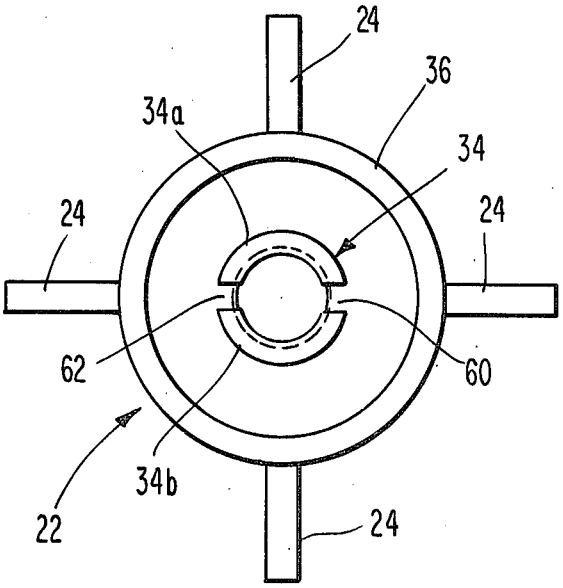
FIG. 5 is an end view of the impeller shown in FIG. 3.

Referring now to FIGS. 3–5, the rotary impeller 22 will be more fully described. FIG. 3 illustrates in greater detail the deformable projection 34 and the circumferential projection 36. The circumferential projection 36 is formed to have an outside diameter less than or equal to the outside diameter of the driven magnet 30. The deformable projection 34 is formed to have a central bore 35 therein. The outside diameter of the deformable projection 34 is not critical provided that it is less than the minimum diameter of the bore 32 of the driven magnet 30.

In the preferred embodiment, as shown, the deformable projection 34 is formed in two sections, 34*a* and 34*b*, which are separated by longitudinal slots 60 and 62. However, it should be realized that a single slot or more than two slots could be provided.

In the assembly of the pump shown in FIG. 1, the bore 32 of the driven magnet 30 is inserted over the two sections of the deformable projection 34. Next, the shaft 38 is inserted through the bore 32 of the driven magnet 30, the central bore 35 of the deformable projection 34 and the central opening 28 in the hub 26. The tapered wedge 44 is then inserted over the shaft 38. The wedge causes the sections 34*a* and 34*b* of the deformable projection to expand radially thus gripping the driven magnet 30 to the hub 26.

The wedge 44 is inserted until it abuts the flange 40 of the shaft 38 and washer 48 is fastened to the threaded end of the shaft 38. Because a portion of the wedge 44 projects beyond the central opening 28, the impeller 22 rotates about the shaft 38 at the wedge 44. Since the wedge 44 is formed of a bushing material such as graphite, wear is reduced. Further, in the preferred embodiment, since the wedge 44 also rotates against the flange 40 of the shaft 38 wear also is reduced in the magnet well 20.

What is claimed is:

1. In a magnetically coupled pump of the type employing a rotary impeller with a hollow cylindrical driven magnet having a bore in axial alignment therewith, which magnet is coaxially attached to a hub portion of said impeller, and the magnet being driven by an annular driving magnet rotating around said driven magnet, improvements comprising:

a deformable projection extending axially from the hub portion into said bore and a wedge inserted into said bore whereby said projection is deformed radially so that said projection tightly abuts said driven magnet.

2. The pump of claim 1 wherein said driven magnet is a sintered ceramic magnet.

3. The pump of claim 1 wherein said projection comprises a slotted cylindrical member having a central bore in axial alignment with the bore of said driven magnet.

4. The pump of claim 3 wherein said hub portion has a central opening, which opening is in axial alignment with said central bore.

5. The pump of claim 4, wherein a portion of said wedge extends through said opening.

6. The pump of claim 5 wherein a shaft extends through said bore, said central bore and said opening and wherein said wedge encircles said shaft.

7. The pump of claim 6 wherein said shaft supports a bushing which abuts the portion of said wedge which extends through said opening.

8. The pump of claim 6 further comprising a circumferential projection surrounding said deformable projection extending from said hub portion to said driven magnet.

9. The pump of claim 6 further comprising a first housing member and a second housing member defining an impeller chamber and a magnet well, said impeller rotating in said impeller chamber and said driven magnet rotating in said magnet well, at least one of said housing members having an anchor therein for receiving said shaft.

10. The pump of claim 8 wherein said wedge is a graphite wedge and wherein said wedge abuts said anchor.

11. The pump of claim 9 wherein said wedge is a graphite wedge and wherein said shaft has a flange abutting said anchors and wherein said wedge abuts said flange.

12. The pump of claim 1 wherein said impeller, including said projection, comprises polyphenylene sulfide.

* * * * *